US009660372B2

(12) United States Patent
Choi

(10) Patent No.: US 9,660,372 B2
(45) Date of Patent: May 23, 2017

(54) WATERPROOF CABLE CONNECTOR

(71) Applicant: LG INNOTEK CO., LTD., Seoul (KR)

(72) Inventor: Mee Nam Choi, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/048,415

(22) Filed: Feb. 19, 2016

(65) Prior Publication Data

US 2016/0359260 A1 Dec. 8, 2016

(30) Foreign Application Priority Data

Jun. 4, 2015 (KR) ..... 10-2015-0079123
Sep. 8, 2015 (KR) ..... 10-2015-0127145
Dec. 2, 2015 (KR) ..... 10-2015-0170764

(51) Int. Cl.

| | |
|---|---|
| ***H01R 13/52*** | (2006.01) |
| ***H01R 24/64*** | (2011.01) |
| *H01R 24/20* | (2011.01) |
| *H01R 24/28* | (2011.01) |
| *H01R 13/623* | (2006.01) |
| *H01R 13/639* | (2006.01) |

(52) U.S. Cl.

CPC ..... *H01R 13/5202* (2013.01); *H01R 24/64* (2013.01); *H01R 13/5213* (2013.01); *H01R 13/623* (2013.01); *H01R 13/6392* (2013.01); *H01R 24/20* (2013.01); *H01R 24/28* (2013.01)

(58) Field of Classification Search

CPC .... H01R 13/5202; H01R 24/20; H01R 24/28; H01R 13/516; H01R 13/5221; H01R 13/5219; H01R 13/6277; H01R 13/5808

USPC ..... 439/271

See application file for complete search history.

(56) References Cited

U.S. PATENT DOCUMENTS

| | | | | |
|---|---|---|---|---|
| 9,425,540 | B2 * | 8/2016 | Schnurpfeil | H01R 13/516 |
| 2003/0100215 | A1 * | 5/2003 | Bachman | H01R 13/516 439/462 |
| 2011/0097917 | A1 * | 4/2011 | Coyle, Jr. | H01R 13/5219 439/271 |
| 2012/0312346 | A1 * | 12/2012 | Roman, Jr. | H01R 13/5808 136/244 |
| 2013/0084728 | A1 * | 4/2013 | Omae | H01R 4/646 439/271 |

(Continued)

FOREIGN PATENT DOCUMENTS

| | | |
|---|---|---|
| JP | 2013-243065 A | 12/2013 |
| KR | 20-0357980 B | 8/2004 |

(Continued)

OTHER PUBLICATIONS

KIPO Office Action dated Oct. 4, 2016 for Korean Patent Application No. 10-2015-0170764 which corresponds to the above-referenced U.S. application.

*Primary Examiner* — Jean F Duverne
(74) *Attorney, Agent, or Firm* — LRK Patent Law Firm

(57) ABSTRACT

A waterproof cable connector includes a first cable terminal for transmitting or receiving electrical signals of a first cable to or from a second cable, a waterproof member combined with the first cable to perform a waterproof function of the first cable terminal, and a first fastener wrapping the first cable terminal and the waterproof member.

11 Claims, 9 Drawing Sheets

(56) References Cited

U.S. PATENT DOCUMENTS

| | | | | |
|---|---|---|---|---|
| 2013/0203277 | A1* | 8/2013 | Gaubert | H01R 13/6277 439/271 |
| 2014/0148030 | A1* | 5/2014 | Makimura | H01R 13/5219 439/271 |
| 2014/0256166 | A1* | 9/2014 | Ramos | H01R 13/5221 439/271 |

FOREIGN PATENT DOCUMENTS

| | | | |
|---|---|---|---|
| KR | 20-0392268 | B | 8/2005 |
| KR | 10-2011-0060797 | A | 6/2011 |
| KR | 10-1330648 | B | 11/2013 |

* cited by examiner

WATERPROOF CABLE CONNECTOR

CROSS-REFERENCE TO RELATED APPLICATIONS

This application claims priority under 35 U.S.C. §119 to Korean Patent Application Nos. 10-2015-0079123, filed Jun. 4, 2015, 10-2015-0127145, filed Sep. 8, 2015, and 10-2015-0170764, filed Dec. 2, 2015, the disclosure of which is incorporated herein by reference in its entirety.

BACKGROUND OF THE INVENTION

1. Field of the Invention

The present invention relates to a waterproof cable connector including a first cable terminal for transmitting or receiving electrical signals of a first cable to or from a second cable, a waterproof member combined with the first cable to perform a waterproof function of the first cable terminal, and a first fastener wrapping the first cable terminal and the waterproof member.

2. Description of Related Art

Generally, a connector refers to a connection terminal for transmitting or receiving electrical signals of an analog or digital form (image signals, voice signals, data signals or the like), which can transfer the electrical signals to another device connected to the connector. In addition, the connection terminal may be used to extend a cable to be connected when the length of the cable is insufficient.

Such a cable connector can be exposed to outside in which surrounding environments can be changed severely, and the connector part can be exposed to moisture in the process of burying a cable in a wall or the ground when a building in which the cable is used is constructed.

Since the cable connector exposed to moisture or water has a risk of bad connection or disconnection, the cable connector has been used in the form of a waterproof cable connector designed for moisture-proof and waterproof. In the case of a conventional cable connector, a waterproof member is additionally included and inserted in a cable to accomplish a waterproof function when the cable connector is used to connect cables on both sides.

However, in the conventional cable connector, since the length of a portion for connecting a cable is unnecessarily long, the cases of hindering free use of the cable are increased due to the increased thickness and weight of the connector itself, and thus necessity of a cable connector capable of sufficiently implementing the waterproof and moisture-proof function while reducing the length of the connector itself is emerged.

SUMMARY

Therefore, the present invention has been made in view of the above problems of existing cable connectors, and it is an object of the present invention to provide a waterproof cable connector using a waterproof member performing a waterproof function of a cable terminal.

The technical problems to be solved in the present invention are not limited to those mentioned above, and various technical problems can be included within the scope apparent to those skilled in the art from the following descriptions.

To accomplish the above object, according to one aspect of the present invention, there is provided a waterproof cable connector including: a first cable terminal for transmitting or receiving electrical signals of a first cable to or from a second cable; a waterproof member combined with the first cable to perform a waterproof function of the first cable terminal; and a first fastener wrapping the first cable terminal and the waterproof member.

In addition, the waterproof cable connector according to an embodiment of the present invention further includes a second fastener having a connection groove that can be electrically connected to the first cable terminal and capable of being engaged with the first fastener. At this point, an external thread is formed on the second fastener and can be combined with an internal thread formed on the first fastener.

In addition, in the waterproof cable connector according to an embodiment of the present invention, an accommodation hole having a shape complementing an outer appearance of the first cable terminal is formed in the waterproof member. At this point, the waterproof member has an incised groove formed by cutting part of the waterproof member to be connected to the accommodation hole, and the waterproof member is cut into two pieces to be inserted in the first cable.

In addition, in the waterproof cable connector according to an embodiment of the present invention, the first cable terminal is a registered jack.

In addition, the waterproof cable connector according to an embodiment of the present invention further includes a waterproof ring engaged between the first fastener and the second fastener to perform a waterproof function.

In addition, in the waterproof cable connector according to an embodiment of the present invention, an inner diameter of a rear part of the first fastener is larger than a diagonal width of the first cable terminal.

In addition, in the waterproof cable connector according to an embodiment of the present invention, a stopper is formed at a rear part of the first fastener to prevent separation of the waterproof member by a stopping part formed at a rear end of the waterproof member.

In addition, in the waterproof cable connector according to an embodiment of the present invention, an inner diameter of the stopper is larger than a diagonal width of the first cable terminal.

In addition, in the waterproof cable connector according to an embodiment of the present invention, the first fastener is tapered to have a reduced diameter.

DETAILED DESCRIPTION OF EMBODIMENTS

Figure 1:
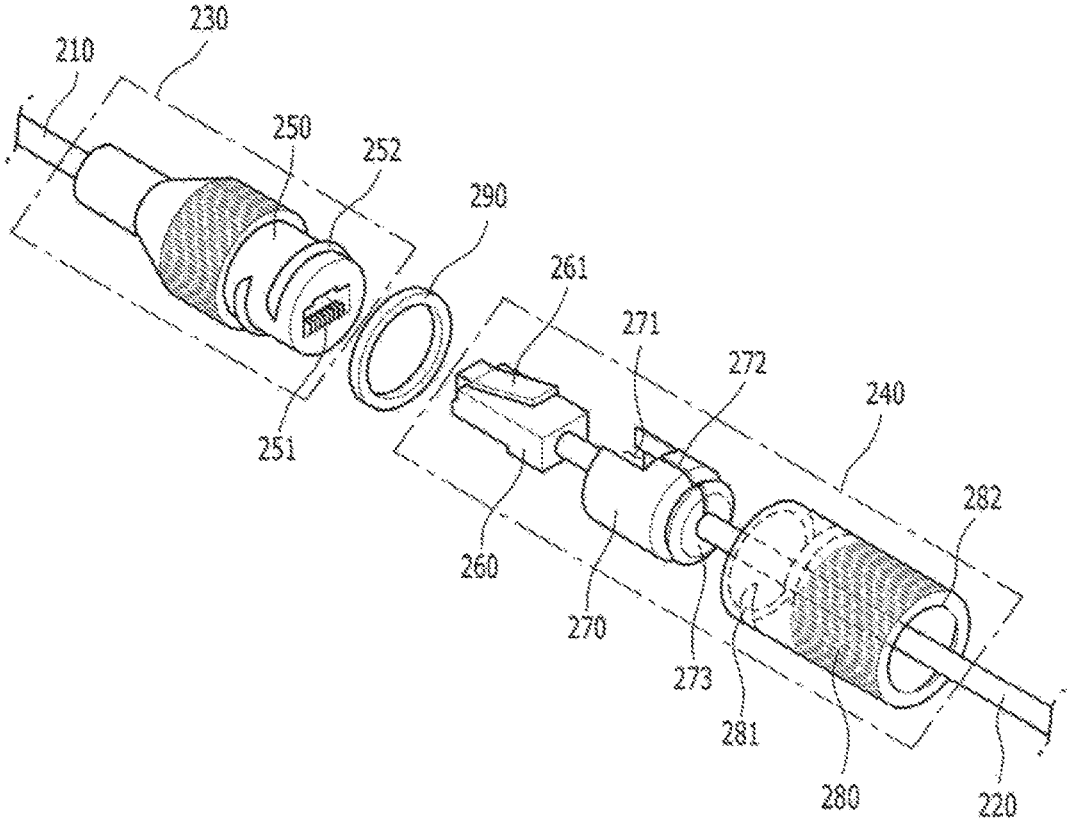
FIG. 1 is a perspective view showing a waterproof cable connector according to an embodiment of the present invention.

Hereinafter, a 'waterproof cable connector' according to the present invention will be described in detail with reference to the accompanying drawings. The disclosed embodiments are provided to enable those skilled in the art to easily understand the scope of the present invention, and the present invention is not limited by such embodiments. Moreover, matters illustrated in the drawings are schematized in order to describe or explain the embodiments of the present invention more easily, and hence, may be different from forms embodied actually.

Meanwhile, the constitutional components expressed below are merely examples for implementing the present invention. Accordingly, other components may be used in other implementations of the present invention without departing from the spirit and scope of the present invention.

In addition, the expression of 'including' an element is an expression of an 'open type' which merely refers to existence of a corresponding component, and it should not be construed as precluding additional components.

In addition, expressions such as 'a first, a second' or the like are used only for the purpose of distinguishing a plurality of configurations and do not limit sequences among the configurations or other features.

FIG. 1 is a perspective view showing a waterproof cable connector according to an embodiment of the present invention.

Referring to FIG. 1, a waterproof cable connector of the present invention may include a first cable terminal 260, a waterproof member 270 and a first fastener 280.

The first cable terminal 260 transmits or receives electrical signals of a first cable 220 to or from a second cable. At this point, the first cable 220 may include all kinds of cables that can be extended by the connector, such as an Internet line, a phone line, an optical cable, a ribbon cable, a coaxial cable or a multicore cable for transmitting or receiving data between configuration components of a network or a power line, a power transmission line or the like for transmitting a current to a load terminal.

In addition, all kinds of connection terminals for connecting to the connector at an end of the first cable 220 can be used as the first cable terminal 260, and all kinds of cable connectors suitable for transmission and reception signals of the first cable 220, such as a registered jack (RJ) in the case of an Internet line or a phone line, an RF connector in the case of a coaxial cable, an optical cable connector in the case of an optical cable, a 110V adapter, a 220V adapter or a plug in the case of a power line, can be used.

The waterproof member 270 is combined with the first cable 220 and performs a waterproof function of the first cable terminal 260. At this point, the waterproof member 270 may be formed of a hydrophobic material including rubber, silicon, paraffin, plastic, nylon, a zirconium compound, a carbamide or the like.

Figure 3A:
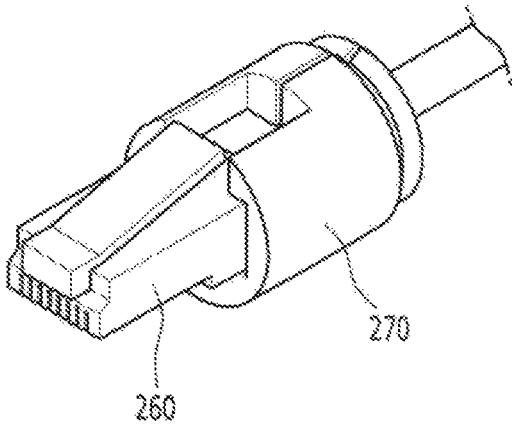
FIGS. 3*a* to 3*c* are configuration views showing the configuration of combining a waterproof member of a waterproof cable connector according to an embodiment of the present invention with an accommodation hole of a first cable terminal.
Figure 3B:
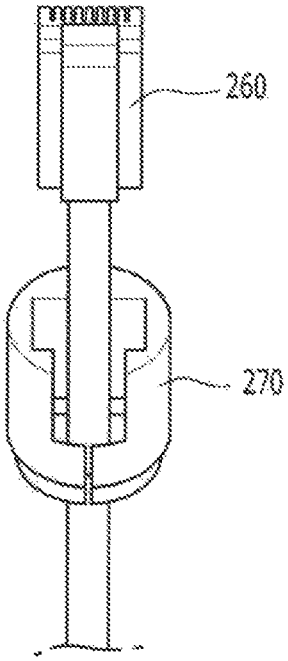
Figure 4A:
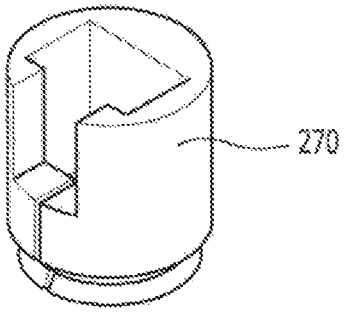
FIGS. 4*a* to 4*d* are perspective views and exemplary views showing a waterproof member of a waterproof cable connector according to an embodiment of the present invention.
Figure 4B:
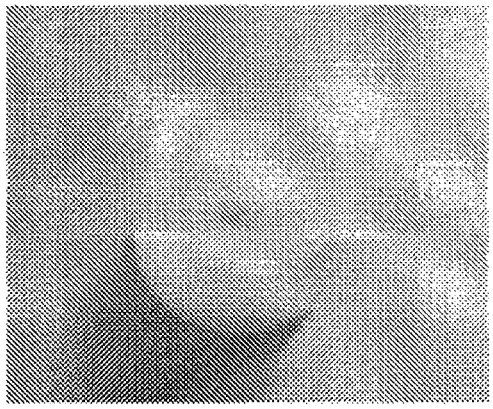
Figure 4C:
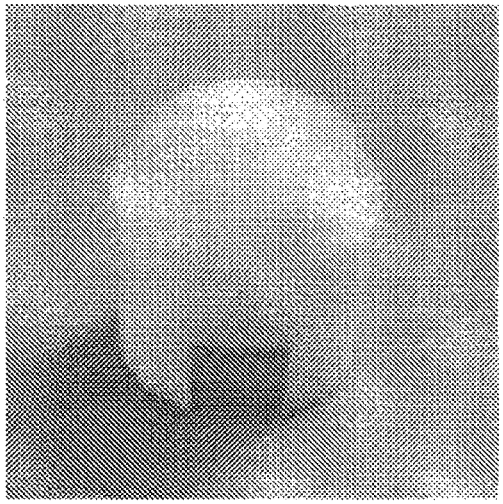
Figure 4D:
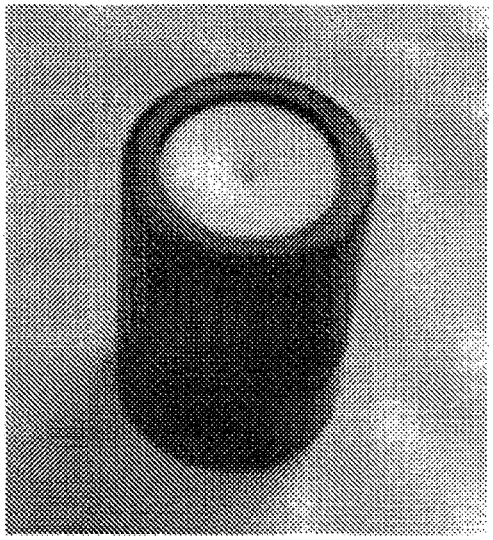

In addition, the waterproof member 270 has an accommodation hole 271 formed in a shape complementing the outer appearance of the first cable terminal 260. Referring to FIGS. 4*a*, 4*b* and 4*c*, since the accommodation hole 271 is negatively carved in a shape exactly corresponding to the protruding shape of the rear part of the cable terminal 260, if the waterproof member 270 is combined with the cable terminal 260 as shown in FIGS. 3*a* and 3*b*, they can be tightly combined without separately creating a space at the combined position.

In addition, the waterproof member 270 has an incised groove 272 formed by cutting part of the waterproof member 270 to be connected to the accommodation hole 271. For example, although the first cable 220 can be sold in a state that the waterproof member 270 is originally inserted in the first cable 220 when the first cable 220 is sold, the waterproof member 270 can be sold separately. Accordingly, the incised groove 272 can be formed in the waterproof member 270 so that the waterproof member 270 may be connected to the first cable 220, and the waterproof function can be accomplished by inserting the waterproof member 270 in the first cable 220 after slightly opening the partially cut incised groove 272 and combining the accommodation hole 271 with the cable terminal 260. In addition, since the incised groove 272 is formed in the waterproof member 270, the waterproof member 270 can be inserted in the first cable 220 through the incised groove although thickness of the first cable 220 is changed.

Figure 3C:
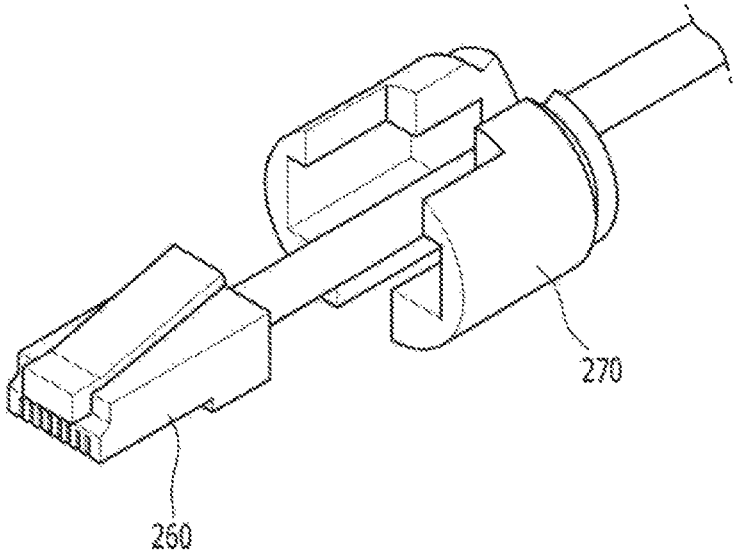

In another embodiment of the present invention, as shown in FIG. 3*c*, the waterproof member 270 may be cut into two pieces to be inserted in the first cable 220. That is, since the waterproof member 270 is cut into two pieces, the waterproof member can be combined in a method of inserting each of the pieces in the cable and wrapping the waterproof member 270 with the first fastener 280.

The first fastener 280 performs a function of wrapping the first cable terminal 260 and the waterproof member 270. After the waterproof member 270 is combined with the first cable terminal 260, the first fastener 280 is combined to perform a sealing function so that water or moisture may not get into the rear side of the waterproof member. At this point, an incised groove that can be used for combining the first cable 220 is formed at one side on the side surface of the first fastener 280 so as to be directly combined with the first cable.

Figure 2A:
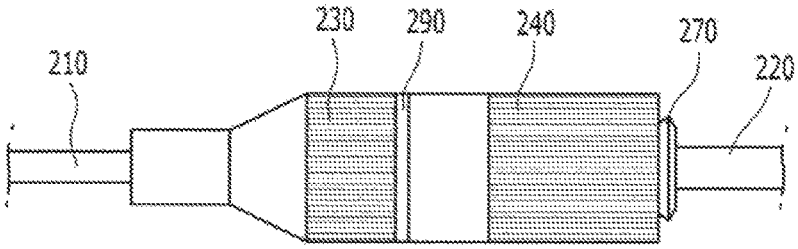
FIGS. 2*a* to 2*d* are configuration views showing a view of connecting a waterproof cable connector according to an embodiment of the present invention.
Figure 2B:
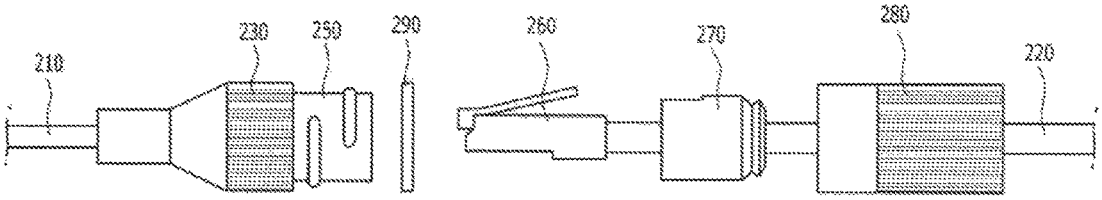
Figure 2C:
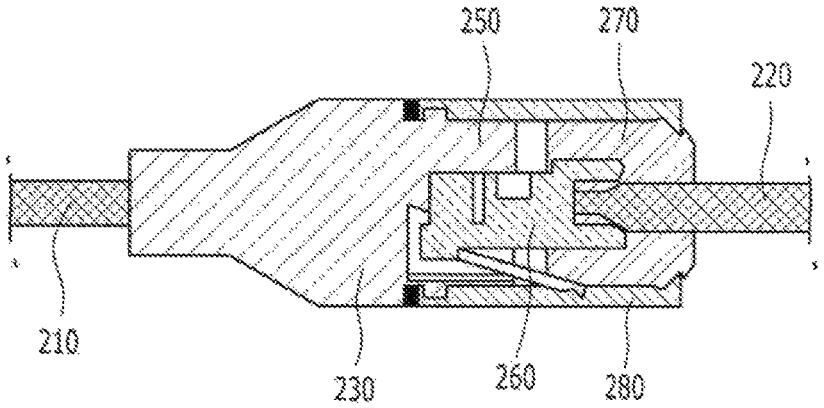
Figure 2D:
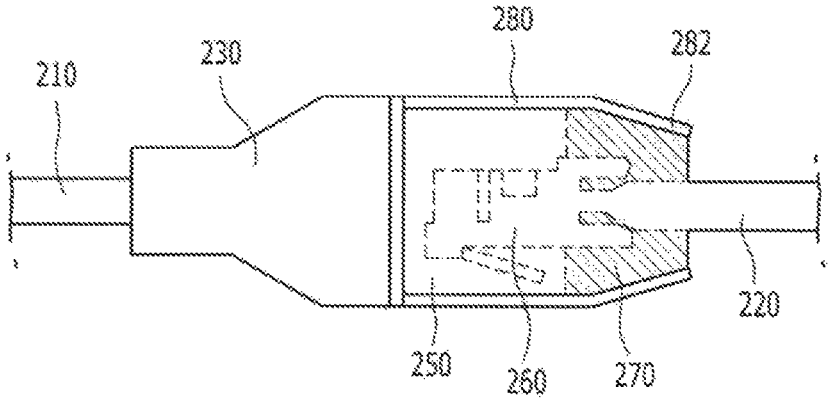

At this point, a stopper 282 is formed at the rear part of the first fastener 280 as shown in FIG. 2*d* so that separation of the waterproof member 270 can be prevented by a stopping part 273 formed at the rear end of the waterproof member 270. Since the waterproof member 270 may freely move the first cable 220, the protruding stopper 282 is formed at the rear part of the first fastener 280 to fix the waterproof member 270 at the stopping part of the waterproof member.

In addition, the first fastener 280 is tapered to have a reduced diameter as shown in FIG. 2*d*. Since the first fastener 280 has a configuration gradually narrowed toward the back of the first fastener 280, the rear part of the first fastener firmly tightens the waterproof member when the first fastener is combined with the waterproof member 270, and the waterproof and moisture-proof function of the waterproof member can be enhanced furthermore.

FIGS. 2*a* to 2*d* are configuration views showing a view of connecting a waterproof cable connector according to an embodiment of the present invention.

Referring to FIGS. 2*a* to 2*d*, the waterproof cable connector of the present invention may further include a second fastener 250 having a connection groove 251 that can be electrically connected to the first cable terminal 260 and capable of being engaged with the first fastener 280.

The second fastener 250 can be combined with the first fastener 280, and, at this point, an external thread 252 is formed on the second fastener 250 and can be combined with an internal thread 281 formed on the first fastener 280.

At this point, all kinds of combination methods which can firmly tighten two members such as a clip, a pin, friction welding or the like can be used for the combination between the second fastener and the first fastener.

The connection groove 251 can be electrically connected to the first cable terminal 260. At this point, all kinds of connection devices connectable to the first cable terminal 260 can be used as the connection groove 251, and a connection device that can be connected to all kinds of cable connectors, such as a registered jack (RJ) in the case of an Internet line or a phone line, an RF connector in the case of a coaxial cable, an optical cable connector in the case of an optical cable, a 110V adapter, a 220V adapter or a plug in the case of a power line, can be used.

In addition, the waterproof cable connector of the present invention may further include a waterproof ring 290 engaged between the first fastener 280 and the second fastener 250 to perform a waterproof function. Since water or moisture can get into the connection gap between the first fastener 280 and the second fastener 250, a waterproof ring which can perform a waterproof function can be inserted therebetween. At this point, like the waterproof member 270, the waterproof ring 290 may be formed of a hydrophobic material including rubber, silicon, paraffin, plastic, nylon, a zirconium compound, a carbamide or the like.

Figure 5A:
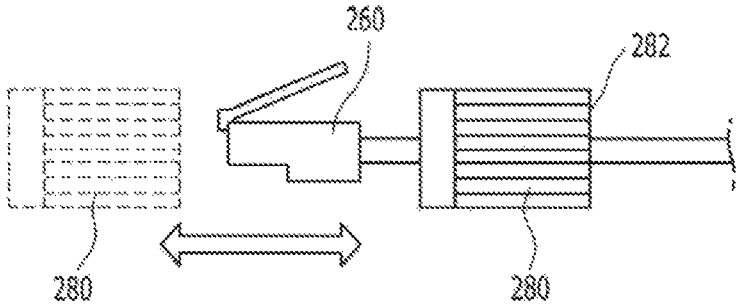
FIG. 5*a* is a view showing an example of combining a first fastener and a first cable terminal of the present invention.

FIG. 5*a* is a view showing an example of combining a first fastener and a first cable terminal of the present invention. Referring to FIG. 5*a*, in the waterproof cable connector, the first fastener 280 is engaged with or disengaged from a line connected to the first cable terminal 260. At this point, when the inner diameter of the first fastener is too small, since there is a problem in that the first fastener is stopped to and unable to be detached from the first cable terminal 260, the inner diameter of the first fastener should be properly adjusted. In addition, when a stopper is formed at the rear part of the first fastener, also the inner diameter of the stopper should be properly adjusted.

At this point, since the waterproof member is cut into two pieces or has an incised groove formed by cutting part of the waterproof member to be inserted in the first cable, the waterproof member may be inserted after the first fastener is engaged with the first cable terminal.

Figure 5B:
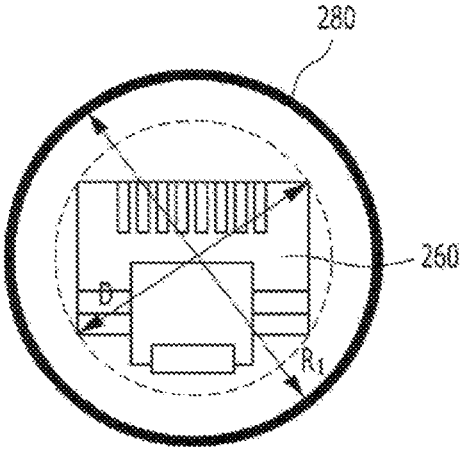
FIGS. 5*b* and 5*c* are cross-sectional views comparing a diameter of a first fastener and a size of a first cable terminal when the first connector and the first cable terminal of the present invention are combined.
Figure 5C:
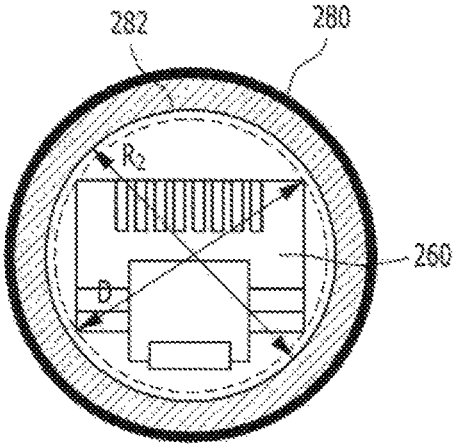

FIGS. 5*b* and 5*c* are cross-sectional views comparing a diameter of a first fastener and a size of a first cable terminal when the first connector and the first cable terminal of the present invention are combined.

Referring to FIG. 5*b*, the inner diameter R1 of the rear part of the first fastener 280 of the present invention is larger than the diagonal width D of the first cable terminal 260. At this point, although the first fastener may be formed in a cylindrical shape having a uniform inner diameter R1, the first fastener may be tapered to have a reduced diameter. In addition, the inner diameter of the first fastener may not be uniform like the shape of an hourglass or the like. Accordingly, the narrowest inner diameter R1' of the first fastener is larger than the diagonal width D of the first cable terminal 260.

Meanwhile, referring to FIG. 5*c*, a stopper 282 may be formed at the rear part of the first fastener 280 of the present invention to prevent separation of the waterproof member. Since the stopper 282 is formed at the rear part of the first fastener 280 to maximize the waterproof function of the waterproof member, the inner diameter R2 of the stopper is generally smaller than the diameter R1 of the first fastener. Accordingly, in the waterproof cable connector of the present invention, in order to solve the problem of the first fastener being stopped to and unable to be detached from the first cable terminal 260, the inner diameter R2 of the stopper is adjusted to be larger than the diagonal width D of the first cable terminal. However, if the inner diameter R2 of the stopper is larger than the narrowest inner diameter R1' of the first fastener, the diagonal width D of the first cable terminal should be adjusted according to the narrowest inner diameter R1' of the first fastener.

At this point, the diagonal width D of the first cable terminal 260 refers to the maximum collision size that the first cable terminal 260 has, and the diagonal width can be adjusted according to the shape of the first cable terminal based on the diameter D' of the circumscribed circle that the cross section of the first cable terminal has.

Figure 6A:
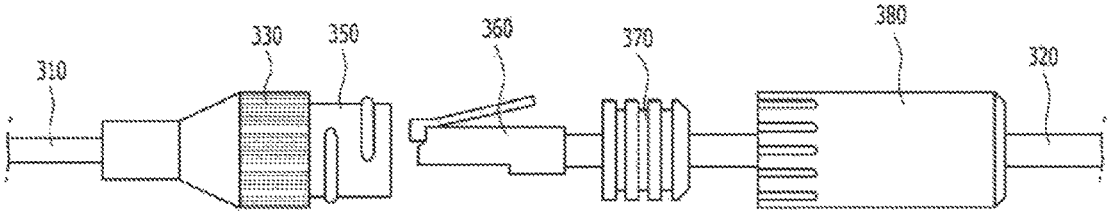
FIGS. 6*a*, 6*b* and 6*c* are exemplary views showing a waterproof cable connector according to another embodiment of the present invention.
Figure 6B:
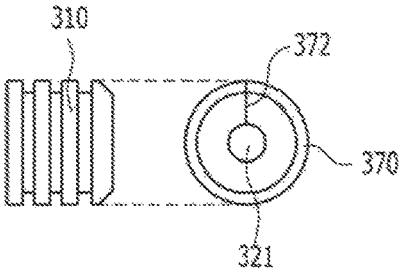
Figure 6C:
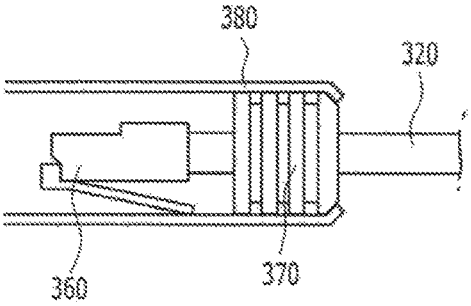

FIGS. 6*a*, 6*b* and 6*c* are exemplary views showing a waterproof cable connector according to another embodiment of the present invention.

Referring to FIGS. 6*a*, 6*b* and 6*c*, a waterproof cable connector according to another embodiment of the present invention may include a first cable terminal 360, a waterproof member 370 and a first fastener 380.

The first cable terminal 360 transmits or receives electrical signals of a first cable to or from a second cable, and the first fastener 380 performs a function of wrapping the first cable terminal and the waterproof member. At this point, the first cable terminal and the first fastener may be implemented to have a configuration the same as that of the waterproof cable connector according to an embodiment of FIGS. 2*a* to 5*c*.

The waterproof member 370 is combined with the first cable and performs a waterproof function of the first cable terminal. At this point, the waterproof member may have an incised groove 372 formed by cutting part of the waterproof member to be combined with the first cable without a extra connection groove or accommodation hole. A first cable combining hole 321 is formed in the waterproof member so that the waterproof member may be combined with the first cable, and after tightly attaching the waterproof member behind the first cable terminal 360 of the first cable 320, the first cable terminal and the waterproof member are wrapped by the first fastener 380.

Since an accommodation hole having a shape complementing the outer appearance of the first cable terminal is not separately formed as is shown in FIG. 2*c*, the manufacturing cost of the waterproof member can be reduced, and the waterproof cable connector can be implemented in a simple shape and form.

In addition, the waterproof member may have a plurality of protruding stopping parts on the waterproof member. When the first fastener wraps the waterproof member, the stopping parts of the waterproof member may prevent the waterproof member from being slid or separated from the waterproof cable connector. In addition, since the stopping parts of the waterproof member are formed in plurality, water or moisture which is not yet waterproofed or moisture-proofed by the first fastener and the waterproof member can be effectively blocked.

Meanwhile, all the features of the waterproof cable connector described above with reference to FIGS. 2*a* to 5*c* can be applied to the waterproof cable connector according to another embodiment of FIGS. 6*a* to 6*c*.

Compared with a conventional cable connector, since the waterproof cable connector of the present invention includes a waterproof member having an accommodation hole formed in a shape complementing the outer appearance of a cable terminal, a stopper part formed in the middle of the conventional cable connector can be removed, and the length of the cable connector itself can be reduced.

In addition, the waterproof cable connector of the present invention may minimize the length of the cable connector itself, which is thicker than a general cable by the nature. For example, only holes of a minimum size as small as to pass a cable are drilled when a building is constructed, and hindrance of the cable can be avoided when a building is constructed by minimizing the length of the cable connector.

In addition, in the waterproof cable connector of the present invention, since the waterproof member has an incised groove formed by cutting part of the waterproof member to be connected to the accommodation hole of the waterproof member, the waterproof cable connector can be used in a method of separately purchasing the waterproof member and the first fastener and inserting them in a general LAN cable.

In addition, in the waterproof cable connector of the present invention, since the first fastener is tapered to have a reduced diameter and the gap of the waterproof member is sealed when the first fastener and the second fastener are combined, the waterproof cable connector may effectively implement the waterproof and moisture-proof function.

In addition, since the inner diameter of the first fastener is properly adjusted to solve the problem of the first fastener being stopped to and unable to be detached from the first cable terminal, the waterproof cable connector of the present invention can be engaged without cutting the first cable connected to the first cable terminal, and thus it is easy to maintain and replace the waterproof cable connector.

The embodiments of the present invention described above have been disclosed for illustrative purposes, and the present invention is not restricted by the embodiments. In addition, those skilled in the art can make various changes or modifications within the spirit and scope of the present invention, and those changes and modification should be regarded as being within the scope of the present invention.

What is claimed is:

1. A waterproof cable connector comprising:

a first cable terminal for transmitting or receiving electrical signals of a first cable to or from a second cable;

a waterproof member combined with the first cable to perform a waterproof function of the first cable terminal; and a first fastener wrapping the first cable terminal and the waterproof member, wherein the waterproof member has an accommodation hole formed in a shape complementing an outer appearance of the first cable terminal.

2. The connector according to claim 1, further comprising a second fastener having a connection groove that is electrically connected to the first cable terminal and being engaged with the first fastener.

3. The connector according to claim 2, wherein an external thread is formed on the second fastener and combined with an internal thread formed on the first fastener.

4. The connector according to claim 1, wherein the waterproof member has an incised groove formed by cutting part of the waterproof member to be connected to the accommodation hole.

5. The connector according to claim 1, wherein the waterproof member is cut into two pieces to be inserted in the first cable.

6. The connector according to claim 1, wherein the first cable terminal is a registered jack.

7. The connector according to claim 1, further comprising a waterproof ring engaged between the first fastener and the second fastener to perform a waterproof function.

8. The connector according to claim 1, wherein an inner diameter of a rear part of the first fastener is larger than a diagonal width of the first cable terminal.

9. The connector according to claim 1, wherein a stopper is formed at a rear part of the first fastener to prevent separation of the waterproof member by a stopping part formed at a rear end of the waterproof member.

10. The connector according to claim 9, wherein an inner diameter of the stopper is larger than a diagonal width of the first cable terminal.

11. The connector according to claim 1, wherein the first fastener is tapered to have a reduced diameter.

* * * * *